US006786815B1

(12) United States Patent
Folsom

(10) Patent No.: US 6,786,815 B1
(45) **Date of Patent: *Sep. 7, 2004**

(54) APPARATUS FOR VENTING ROOMS WITH EXHAUST FANS

(75) Inventor: William D. Folsom, Houston, TX (US)

(73) Assignee: Hy-Tech Inventions, Inc., Spring, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/639,321

(22) Filed: Aug. 12, 2003

(51) Int. Cl.[7] ..... F24F 7/02

(52) U.S. Cl. ..... 454/18; 4/11; 4/218; 454/345; 454/365; 454/366

(58) Field of Search ..... 454/18, 19, 339, 454/341, 345, 353, 359, 360, 365, 366; 4/211, 218

(56) References Cited

U.S. PATENT DOCUMENTS

| | | | | | |
|---|---|---|---|---|---|
| 1,427,107 | A | * | 8/1922 | Kaplan | 4/211 |
| 1,734,449 | A | * | 11/1929 | Smith et al. | 454/345 |
| 3,192,539 | A | * | 7/1965 | Martz | 4/218 |
| 3,223,018 | A | * | 12/1965 | Tucker | 454/186 |
| 4,051,770 | A | * | 10/1977 | Felter et al. | 454/345 |
| 5,390,451 | A | * | 2/1995 | Kopp et al. | 52/58 |
| 5,394,663 | A | * | 3/1995 | Jackson | 52/199 |
| 5,454,197 | A | * | 10/1995 | Horrigan | 52/199 |
| 5,815,996 | A | * | 10/1998 | Granger | 52/202 |
| 5,890,960 | A | * | 4/1999 | Cronan et al. | 454/365 |
| 6,185,880 | B1 | * | 2/2001 | Richardson | 52/198 |
| 6,378,227 | B1 | | 4/2002 | Bradford | |
| 6,386,972 | B1 | | 5/2002 | Schiedegger et al. | |
| 6,431,972 | B1 | * | 8/2002 | Folsom | 454/18 |
| 6,543,437 | B1 | | 4/2003 | Luu et al. | |

FOREIGN PATENT DOCUMENTS

| | | | | |
|---|---|---|---|---|
| FR | 2 463 366 | * | 2/1981 | 454/345 |

* cited by examiner

*Primary Examiner*—Harold Joyce
(74) *Attorney, Agent, or Firm*—Mary J. Gaskin

(57) ABSTRACT

An apparatus for venting several rooms having exhaust fans through existing roof openings made for existing ventilation systems, including turbine ventilators, roof ventilators, ridge ventilators and hip ventilators. The vent apparatus has two side panels, a bottom and two end panels. The apparatus is mounted under the roof ventilation system, using horizontal mounting elements disposed on the top edges of the end panels and side panels. When a ridge ventilator or hip ventilator is used, the end panels are formed with slots for fitting around the ridge rafter or hip rafter. The apparatus is mounted under the ridge ventilator, using mounting elements disposed along the slots on the end panels to attach the vent apparatus to the rafter. Each circular opening in the body had a stub extending downwardly for attachment of an end of the venting hose, which is connected to the bathroom exhaust vent fan. Removable covers can be placed into unused openings. Odors and moist air are vented from the bathroom, through the bathroom exhaust fan, into the vent hose, into the vent apparatus, and out through the roof ventilator.

11 Claims, 5 Drawing Sheets

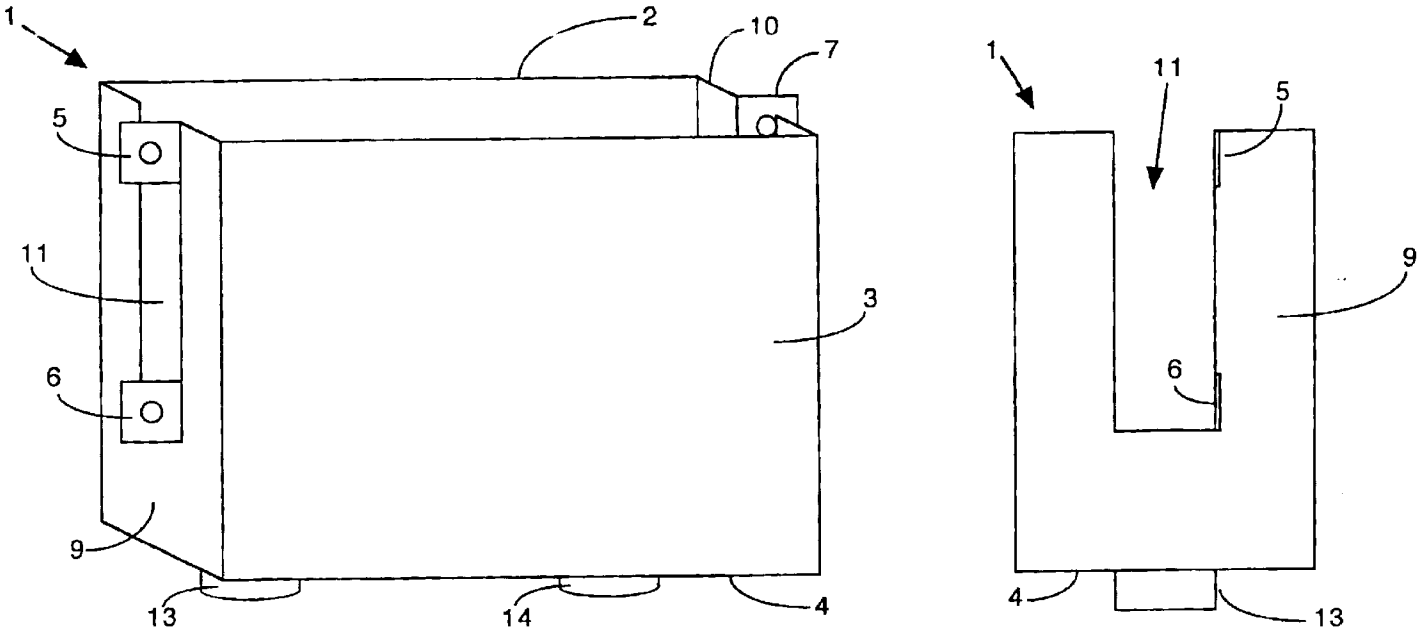
Fig. 1
Fig. 2
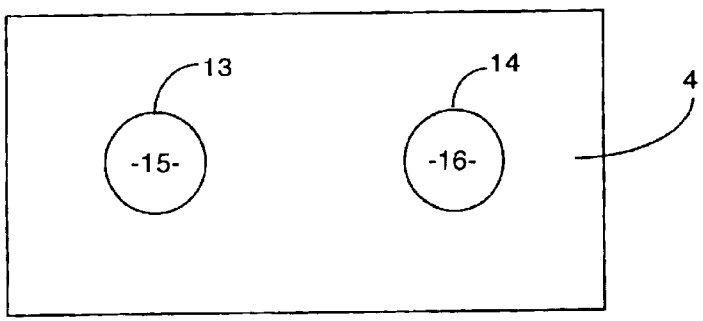
Fig. 3

APPARATUS FOR VENTING ROOMS WITH EXHAUST FANS

FIELD OF THE INVENTION

This invention relates to venting rooms having exhaust fans, and, more specifically, to an apparatus for receiving and containing the exhaust and directing it out through the roof of a building using existing ventilation structures. The invention is related to the disclosure in U.S. Pat. No. 6,431,972, which issued to William D. Folsom, the inventor of the invention disclosed herein.

BACKGROUND OF THE INVENTION

In building structures, it is well known that rooms, particularly bathrooms with exhaust fans, must be vented to the outside in order to prevent odors and moist air from escaping into the interior of the structure. Presently, if building codes permit, construction tradesmen may run vent exhaust fans hoses to the attic spaces, letting the fans exhaust air into the attic. Alternatively, where venting to the outside is required, tradesmen may cut an opening through the roof and install individual flashing, thereby damaging the structural integrity of the roof. Typically, each venting hose requires its own opening. A tradesman may have to cut several holes in the roof of a building in order to properly vent the bathrooms. Each opening presents the possibility of a future leak in the roof around the flashing, which may allow water and moisture to enter the building, with toxic mold a possible result. Finally, the appearance of numerous flashings in a roof can be quite unattractive.

Even more problematic is the possibility that a tradesman may cross-connect bathroom exhaust vents and plumbing drain waste vent systems, even though building codes require separate venting. If that is done, methane gas may enter the bathroom when the exhaust fan is not running.

SUMMARY OF THE INVENTION

The present invention enables tradesmen to utilize pre-existing ventilation systems in order to vent bathrooms with exhaust vent fans, without penetrating the roof.

Currently, several different ventilation systems are used to remove heat from the attic of a building. Turbine ventilators, roof ventilators, ridge ventilators, and hip ventilators work well because they are mounted on the roof above the attic, often near or at the highest point of a building. The present invention provides an apparatus to which one or more bathroom exhaust vent fan hoses can be attached in order to remove odors and moist air from the rooms being ventilated. The vent apparatus of the present invention works in concert with the bathroom exhaust vent fans, which have dampers that close when the exhaust fans are not running, and open when the fans are activated, causing the odors and moist air to flow up and out of the room being vented, through the bathroom exhaust vent fan hose, and into the vent apparatus of the present invention. The vent apparatus can be mounted under any of the several presently-used roof ventilators, allowing odors and moist air to exhaust out of the room being ventilated, through the vent apparatus, and out the roof ventilator. Using the vent apparatus obviates the need to cut additional holes in the roof to vent the exhaust from bathroom exhaust fans. No modifications must be made, either to the roof or to the ventilators.

The vent apparatus of the present invention is typically made, using the process of injection molding, from a tough, rigid plastic such as ABS (acrylonitrile-butadiene-styrene). The vent apparatus, molded in one piece, is essentially rectangular in shape, with two side panels, two end panels, and a bottom, with mounting ears either on the top portion of the two side panels, or protruding from slots in the ends, depending on the type of attic ventilator with which it is utilized. The vent apparatus is formed with one or more openings (each approximately 3" in diameter) in the bottom side, each with a protruding stub to which can be attached the hose from the bathroom exhaust fan being vented, using duct tape or plastic bands designed for that purpose. Covers are placed into unused openings in the vent apparatus; the covers are removable for later use. When the apparatus will be used with a ridge ventilator or a hip ventilator, each end has a slot formed therein, which is fitted around the ridge rafter or hip rafter. A tradesman mounts the vent apparatus around the ridge rafter or hip rafter, directly under the ridge ventilator or hip ventilator. Mounting ears on the two ends are nailed to the ridge rafter or hip rafter.

Finally, an alternate embodiment is disclosed for mounting the apparatus under a turbine ventilator or a roof ventilator. Such a vent apparatus has no slots in the end panels; it has mounting ears on the top edges of the sides in order to mount it to the decking under the turbine ventilator or roof ventilator being utilized.

It is an object of the present invention to provide an apparatus for ventilating bathroom areas, without making additional holes in a roof.

Yet another object of the present invention is to provide an apparatus for consolidating several bathroom exhaust vents and venting them out of the roof at one location.

Still another object of the present invention is to provide a vent apparatus that can be used with the presently existing roof ventilator systems, with no modifications to the roof ventilator or to the roof.

A further object of the present invention is to provide a vent apparatus which is easy to fabricate and to install.

A still further object of the present invention is to provide a vent apparatus which functions with code-approved materials.

BRIEF DESCRIPTION OF THE DRAWINGS

FIG. 1 is a perspective view of the body of the vent apparatus of the present invention, for use with a ridge ventilator or a hip ventilator.

FIG. 2 is a plan view of one of the two identical ends of the body of the vent apparatus, which is installed under a ridge ventilator or a hip ventilator system.

FIG. 3 is a bottom view of the body of the vent apparatus.

DESCRIPTION OF PREFERRED EMBODIMENT

Figure 4:
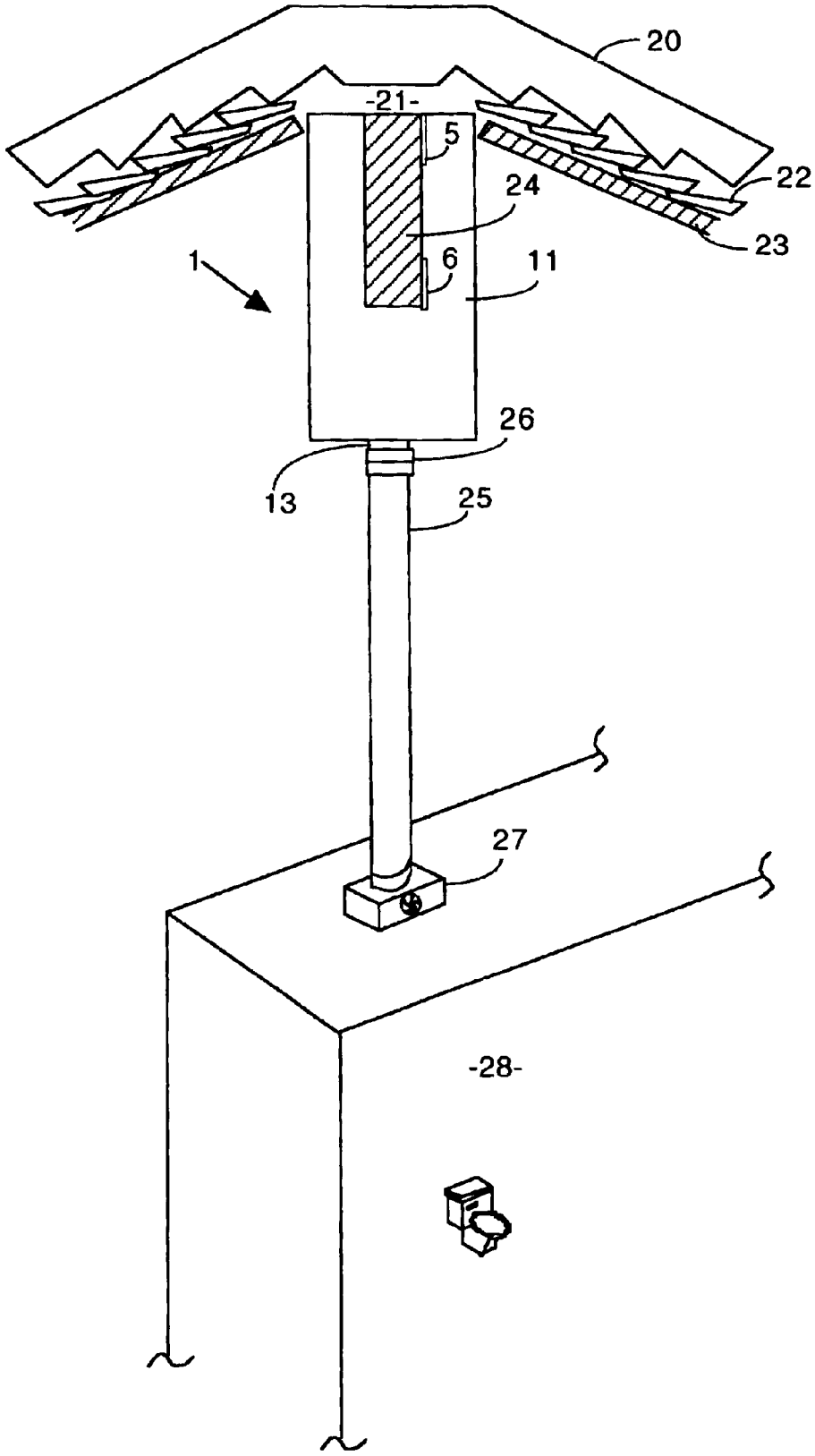
FIG. 4 is a side view of the vent apparatus of the present invention, which has been mounted on the ridge rafter under a ridge ventilator; the lower portion of the drawing is representational of the bathroom being vented.

The vent apparatus of the present invention is typically made from a tough, rigid plastic, such ABS (acrylonitrile-butadiene-styrene), by the process of injection-molding. The body 1 of the vent apparatus used with a ridge ventilator or hip ventilator is shown in FIG. 1. It comprises two side panels 2, 3 and a bottom 4, with mounting ears 5, 6, 7 (8) (each with a hole used for mounting the apparatus) protruding outwardly from the end panels 9, 10 along slots 11,12 cut therein. Stubs 13, 14 extend downwardly from circular openings fabricated in the bottom 4.

FIG. 2 shows one of the end panels 9 of the body I of the vent apparatus which is used with either a ridge ventilator or a hip ventilator. A slot 11 has been cut into the panel 11 in order to allow the body I of the vent apparatus to fit around a ridge rafter or hip rafter (as shown in FIG. 4). Mounting ears 5, 6 extend from the end panel 9 along one side of the slot 11. Stub 13 extends downwardly from the bottom 4.

The rectangular bottom 4 of the body 1 is shown in FIG. 3. Stubs 13, 14 encircle circular openings 15, 16 in the bottom 4. If an opening will not be used for venting a bathroom, a tradesman can push a plastic cap (not shown) into the opening in order to seal it.

In FIG. 4, the body 1 of the apparatus has been mounted under a ridge ventilator 20, which has been installed over ridge vent opening 21 in shingle 22 covered roof decking 23. The end panels 11, (12) of the apparatus are designed to fit around the ridge rafter 24 and can be installed without damaging it in any way. To install the body 1 of the apparatus, a tradesman has used nails through the nail holes to attach the mounting ears 5, 6 on the end panel 11 to the side of the ridge rafter 24. One end of a vent hose 25 has been attached to the protruding stub 13 with a plastic band 26 or duct tape. The other end of the vent hose 25 has been attached to the bathroom exhaust vent fan 27, which is used to vent a bathroom space 28. When the bathroom exhaust vent fan 27 is activated, its damper opens, and odors and moist air are vented from the bathroom space 28 through the bathroom exhaust vent fan 27., into the vent hose 25, through stub 13 into the body 1 of the vent apparatus, and out the ridge vent opening 21 under ridge ventilator 20.

Figure 5:
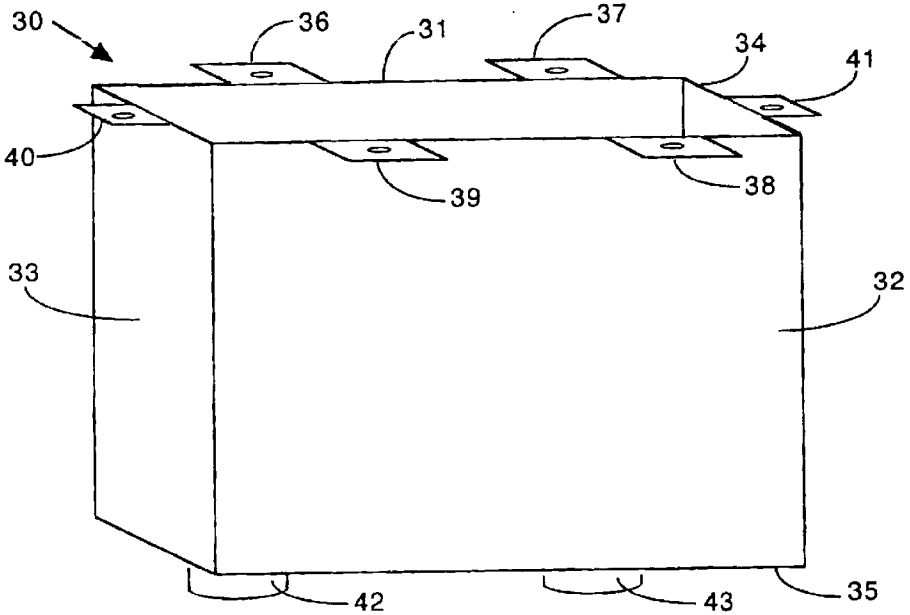
FIG. 5 is a perspective view of the body of the vent apparatus of the present invention, for use with a roof ventilator or a turbine ventilator.

FIG. 5 shows another embodiment of the vent apparatus of the present invention, which can be used with a roof ventilator or a turbine ventilator. The vent apparatus is typically made from a tough, rigid plastic, such ABS (acrylonitrile-butadiene-styrene), by the process of injection-molding. The body 30 of the vent apparatus comprises two side panels 31, 32, two end panels 33, 34, and a bottom 35, with mounting ears 36, 37, 38, 39, 40, 41 (each with a hole used for mounting the apparatus) extending outwardly from the top edges of side panels 31, 32 and end panels 33, 34. Stubs 42, 43 extend downwardly from circular openings fabricated in the bottom 35.

Figure 6:
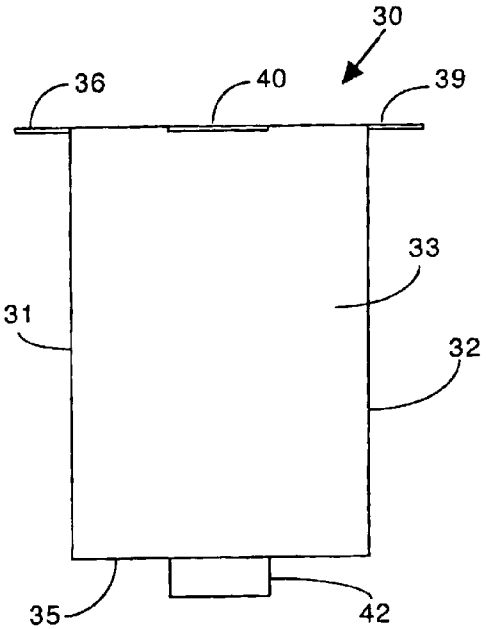
FIG. 6 is a plan view of one of the ends of the body of a vent apparatus which is installed under a roof ventilator or turbine ventilator.

FIG. 6 shows one of the end panels 33 of the body 30 of the vent apparatus which is used with either a roof ventilator or a turbine ventilator. Mounting ears 36, 39, 40 extend from the top edge of side panels 31, 32 and end panel 33. Stub 42 extends downwardly from the bottom 35.

Figure 7:
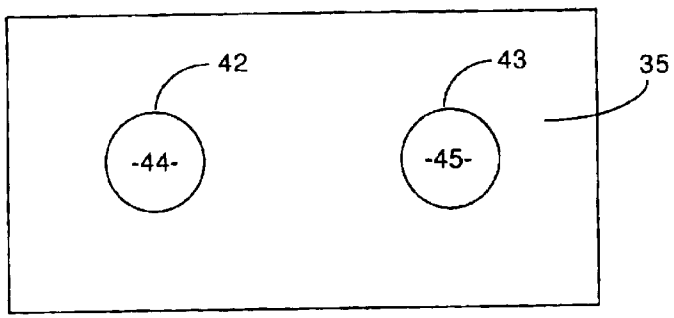
FIG. 7 is a bottom view of the body of the vent apparatus.

The rectangular bottom 35 of the body 1 is shown in FIG. 7. Stubs 42, 43 encircle circular openings 44, 45 in the bottom 35. If an opening will not be used for venting a bathroom, a tradesman can push a plastic cap (not shown) into the opening in order to seal it.

Figure 8:
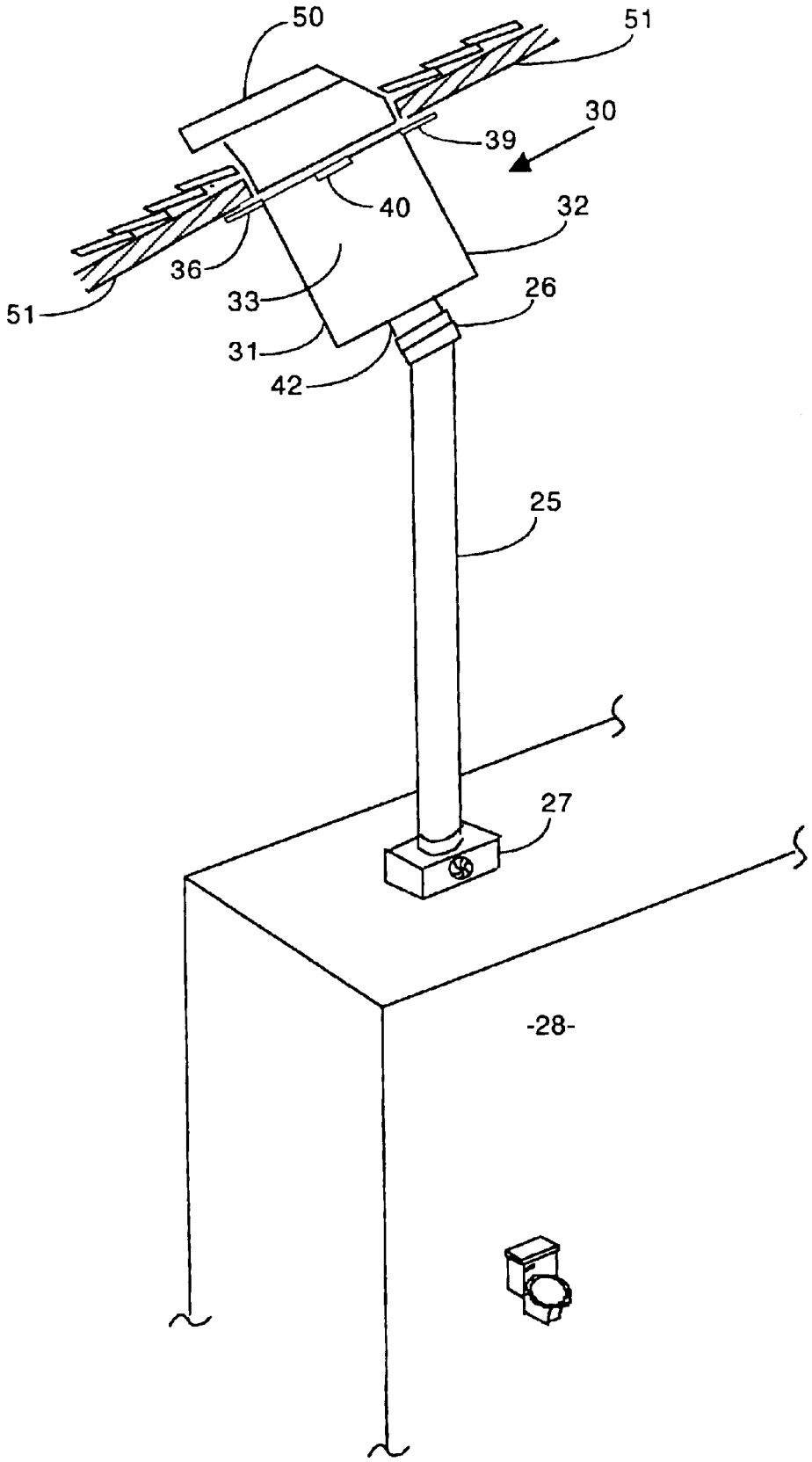
FIG. 8 is a side view of a vent apparatus which has been installed under a roof ventilator; the lower portion of the drawing is representational of the bathroom being vented.

In FIG. 8, the body 30 of the apparatus has been mounted under a ridge ventilator 50. To install the body 30 of the apparatus, a tradesman has used nails through the nail holes to attach the mounting ears 36, 39, 40 on the side panels 31, 32 and end panel 33 to the underside of the roof decking 51. One end of a vent hose 25 has been attached to the protruding stub 42 with a plastic band 26 or duct tape. The other end of the vent hose 25 has been attached to the bathroom exhaust vent fan 27, which is used to vent a bathroom space 28. When the bathroom exhaust vent fan 27 is activated, its damper opens, and odors and moist air are vented from the bathroom space 28 through the bathroom exhaust vent fan 27, into the vent hose 25, through stub 42 into the body 30 of the vent apparatus, and out the roof ventilator 50.

Figure 9:
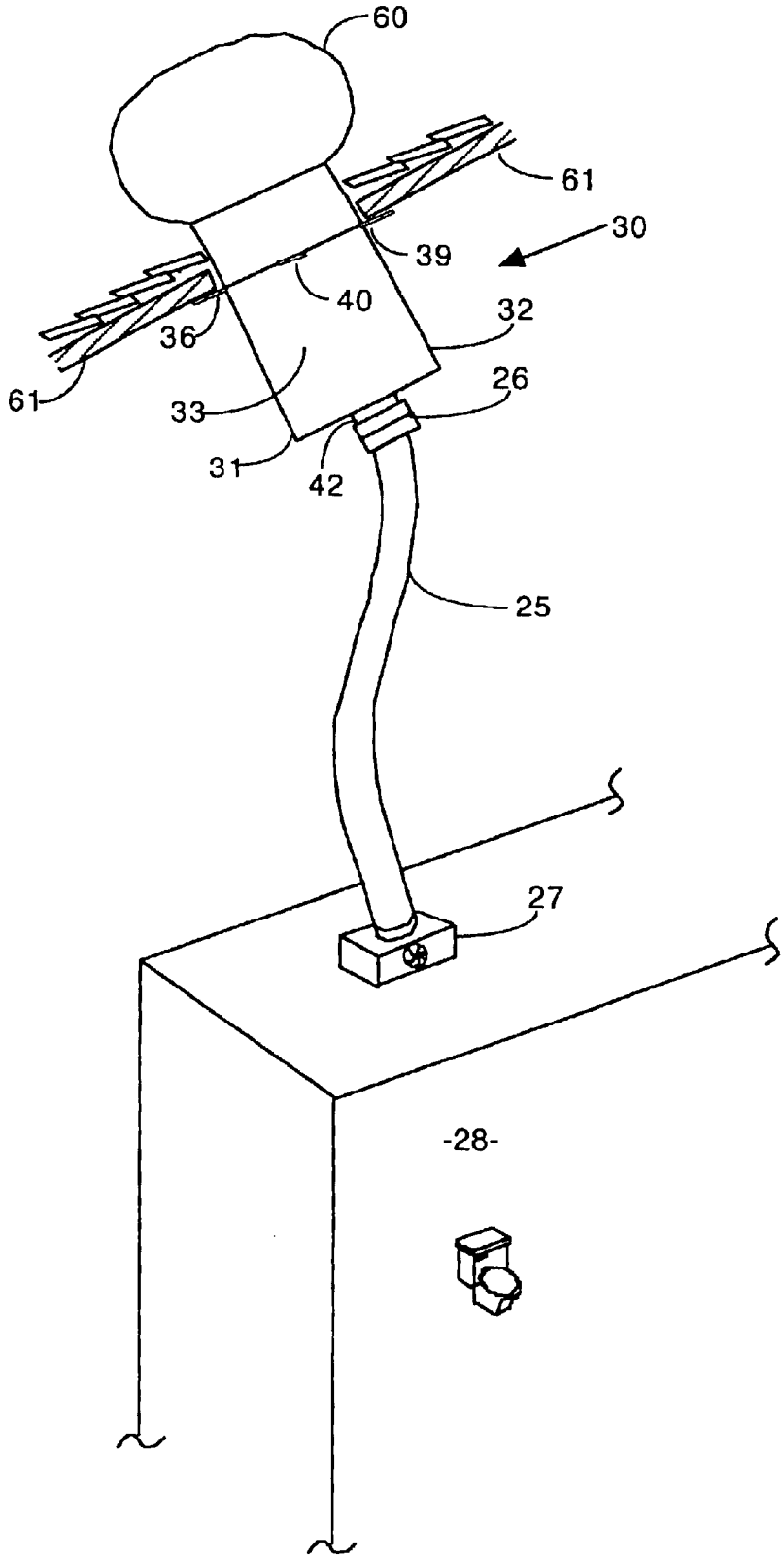
FIG. 9 is a side view of a vent apparatus which has been installed under a turbine ventilator, the lower portion of the drawing is representational of the bathroom being vented.

In FIG. 9, the body 30 of the apparatus has been mounted under a ridge ventilator 60. To install the body 30 of the apparatus, a tradesman has used nails through the nail holes to attach the mounting ears 36, 39. 40 on the side panels 31, 32 and end panel 33 to the underside of the roof decking 61. One end of a vent hose 25 has been attached to the protruding stub 42 with a plastic band 26 or duct tape. The other end of the vent hose 25 has been attached to the bathroom exhaust vent fan 27, which is used to vent a bathroom space 28. When the bathroom exhaust fan 27 is activated, its damper opens, and odors and moist air are vented from the bathroom space 28 through the bathroom exhaust vent fan 27, into the vent hose 25, through stub 42 into the body 30 of the vent apparatus, and out the turbine ventilator 60.

Although the invention has been described with reference to several preferred embodiments, it will be understood by those skilled in the art that additions, modifications, substitutions, deletions and other changes not specifically described are possible, and that the details herein are to be interpreted as illustrative and not as self-limiting.

I claim:

1. An apparatus for venting at least one bathroom exhaust vent fan through a ridge vent installed over a structure's ridge rafter comprising:

a body member having a generally rectangular configuration comprising:

a rectangular bottom with at least one circular opening formed therein, the opening having a cylindrically-shaped stub extending downwardly therefrom;

a rectangular first side with a top edge having formed therefrom a vertical rectangular slot configured to fit around the ridge rafter, the slot having a first side and a second side, the first side of the slot having at least two spaced-apart mounting elements extending outwardly from the first side of the body member;

a rectangular second side disposed opposite the first side, the second side also having a top edge having formed therefrom a vertical rectangular slot configured to fit around the ridge rafter, the slot having a first side and a second side, the first side of the slot having at least two spaced-apart mounting elements extending outwardly from the second side of the body member;

a rectangular third side;

a rectangular fourth side disposed opposite the third side; the stub capable of having affixed thereto an end of a venting hose, the venting hose being connected to the bathroom exhaust vent fan, said fan having a damper.

2. The apparatus of claim 1 which further comprises a removable cylindrical cover for closing the circular opening in the bottom of the body.

3. The apparatus of claim 1 wherein the body member is formed from a tough, rigid plastic material.

4. An apparatus for venting at least one plumbing pipe through a roof vent installed over an opening in a roof comprising:

a body member having a generally rectangular configuration comprising:

a rectangular bottom with at least one circular opening formed therein, the opening having a cylindrically-shaped stub extending downwardly therefrom;

a rectangular first side having a top edge with a horizontal mounting element extending outwardly from the first side of the body member;

a rectangular second side disposed opposite the first side, the second side also having a top edge with a horizontal mounting element extending outwardly from the second side of the body member;

a rectangular third side having a top edge with at least two spaced-apart horizontal mounting elements extending outwardly from the third side of the body member;

a rectangular fourth side disposed opposite the third side, the fourth side also having a top edge with at least two spaced-apart horizontal mounting elements extending outwardly from the fourth side of the body member; the stub capable of having affixed thereto an end of a venting hose, the venting hose being connected to the bathroom exhaust vent fan, said fan having a damper.

5. The apparatus of claim 4 which further comprises a removable cylindrical cover for closing the circular opening in the bottom of the body.

6. The apparatus of claim 4 wherein the body member is formed from a tough, rigid plastic material.

7. A method for venting at least one bathroom exhaust vent fan through a structure's ventilation system comprising the steps of:

providing a generally rectangular body member having a bottom with at least one circular opening, four sides, and mounting elements extending therefrom;

installing the body member under the ventilation system by means of the mounting elements;

attaching an end of a venting hose to the circular opening in the bottom of the body member, the venting hose being connected to the bathroom exhaust vent fan, said fan having a damper;

activating the bathroom exhaust vent fan.

8. The method of claim 7 wherein the ventilation system is selected from a turbine vent and a roof vent.

9. The method of claim 8 wherein the body member is installed by attaching the mounting elements to the underside of roof decking under the ventilation system.

10. The method of claim 7 wherein the ventilation system is a ridge vent installed over a rafter selected from the group consisting of a ridge rafter and a hip rafter.

11. The method of claim 10 wherein the body member has a slot configured to allow the body member to fit around the rafter and wherein the body member is installed by attaching the mounting elements to the rafter.

* * * * *